US006144145A

United States Patent [19]

Jones et al.

[11] Patent Number: 6,144,145

[45] Date of Patent: Nov. 7, 2000

[54] HIGH PERFORMANCE FIELD EMITTER AND METHOD OF PRODUCING THE SAME

[75] Inventors: Gary W. Jones, Lagrangeville; Steven M. Zimmerman, Pleasant Valley, both of N.Y.

[73] Assignee: eMagin Corporation, Hopewell Junction, N.Y.

[21] Appl. No.: 09/073,340

[22] Filed: May 6, 1998

Related U.S. Application Data

[60] Provisional application No. 60/052,351, Jul. 11, 1997.

[51] Int. Cl.[7] ..... H01J 1/30

[52] U.S. Cl. ..... 313/311; 313/336; 313/351; 313/309

[58] Field of Search ..... 313/311, 308, 313/306, 309, 336, 351, 495–497

[56] References Cited

U.S. PATENT DOCUMENTS

| | | | |
|---|---|---|---|
| 4,835,438 | 5/1989 | Baptist et al. | 313/336 X |
| 5,401,676 | 3/1995 | Lee | 313/311 X |
| 5,451,830 | 9/1995 | Huang | 313/336 X |
| 5,469,014 | 11/1995 | Itoh et al. . | |
| 5,522,751 | 6/1996 | Taylor et al. . | |
| 5,527,200 | 6/1996 | Lee et al. . | |
| 5,536,993 | 7/1996 | Taylor et al. . | |
| 5,556,316 | 9/1996 | Taylor et al. . | |
| 5,757,344 | 5/1998 | Miyata et al. | 313/311 X |

*Primary Examiner*—Ashok Patel
*Attorney, Agent, or Firm*—Collier Shannon Scott, PLLC

[57] ABSTRACT

A high performance novel electron emitter material for use in field emission devices is disclosed. The high performance electron emitter material of the invention may comprise a high Cr and SiO mixture. This material may be formed into high aspect ratio, low work function tips which maintain their shape, thus minimizing flash over risks and electron scattering problems, while at the same time permitting a high level of fabrication process flexibility, and minimizing film stresses. One or more impurities which are conductive oxides or will form conductive oxides may be added to the Cr—SiO composition so that a net low work function emitter may be maintained under oxidation. A class of semi-conductive and conductive metal oxides comprises another embodiment of the invention. These materials include oxides of Cr, Mo, Ni, Fe, and Sc, which have current emitting properties desirable for applications where improved electron emission infirmity is desired among emitters within a pixel. Emission from these more resistive emitter tip materials may be optionally enhanced with the addition of low work function impurities such as alkali metals enabling more stable devices while still permitting low turn-on voltages. Methods of making the emitter are also disclosed.

12 Claims, 1 Drawing Sheet

HIGH PERFORMANCE FIELD EMITTER AND METHOD OF PRODUCING THE SAME

CROSS-REFERENCE TO RELATED PATENT APPLICATION

This application relates to and claims priority on U.S. Provisional Application Ser. No. 60/052,351, filed Jul. 11, 1997.

FIELD OF THE INVENTION

The present invention relates to field emissive devices, and in particular to improved, high performance electron emitters.

BACKGROUND OF THE INVENTION

Microminiature field emitters are well known in the microelectronics art. These microminiature field emitters are finding widespread use as electron sources in microelectronic devices. For example, field emitters may be used as a source of electrons in electron guns employed in flat panel displays for use in aviation, automobiles, workstations, laptops, head mounted displays, heads up displays, outdoor signage, or practically any application for a screen which conveys information through light emission. Field emitters may also be used in non-display applications such as power supplies, printers, and X-ray sensors.

When used in a display, the electrons emitted by a field emitter are directed to a cathodoluminescent material. These display devices are commonly called Field Emission Displays (FEDs). A field emitter used in a display may include a microelectronic emission surface, also referred to as a "tip" or "microtip", to enhance electron emissions. Conical, pyramidal, curved and linear pointed tips are often used. Alternatively, a flat tip of low work function material may be provided. An extraction electrode or "gate" may be provided adjacent, but not touching, the field emission tip, forming a field emission gap. Upon application of an appropriate voltage between the emitting electrode and the gate, quantum mechanical tunneling, or other known phenomena, cause the tip to emit electrons. Once emitted, the electrons are predominately affected by the electric field between a highly charged anode and the field emitter. The electrons are accelerated toward the anode.

In microelectronic applications, an array of field emission tips may be formed on the horizontal face of a substrate such as a silicon semiconductor substrate. Emitting electrodes, gates and other electrodes may also be provided on or in the substrate as necessary. Support circuitry may also be fabricated on or in the substrate.

The FEDs may be constructed using various techniques and materials, which are only now being perfected. Preferred FED's may be constructed of semiconductor materials, such as silicon. There are two predominant processes for making field emitters: the "wells first" processes; and the "tips first" processes. In wells first processes, such as a Spindt-type process, the wells are first formed in a material, and tips are later formed in the wells. In the tips first processes, the tips are formed first, and the wells are formed around the tips. There are multitudes of variations of both the wells first and the tips first processes. The present invention is equally applicable to field emitters made by any processes, whether it be wells first, tips first, or some other process.

The electrical theory underlying the operation of an FED is similar to that for a conventional CRT. Electrons emitted from the tips are accelerated by the anode in the direction of an opposing display surface. These high energy electrons strike phosphors on the inside of the display and excite them to luminesce. An image is produced by the pattern of luminescing phosphor pixels as viewed on the display screen by an observer. This process is a very efficient way of generating a lighted image.

In a CRT, one or three electron guns are provided to generate all of the electrons which impinge on the display screen. A complex electron deflection device, usually comprising power-consuming electromagnets, is required in a CRT to direct the electron stream towards the desired pixels. The combination of the electron gun and deflection device behind the screen necessarily make a CRT display relatively thick.

FEDs, on the other hand, may be relatively thin. Each pixel of an FED has its own electron source, typically an array or grouping of emitting microtips, which may share a common conductive base pad. The electric field between the cathode and the gate causes electrons to be emitted from the microtips. FEDs are thin because the microtips and gates, which are the equivalent of an electron gun in a CRT, are extremely small. Further, an FED does not require a deflection device, because each pixel has its own electron gun (i.e. gate and emitters) positioned directly behind it. The emitters need only be capable of emitting electrons in a direction generally normal to the FED substrate and toward the anode.

Because of the unique benefits and numerous potential applications for FEDs, research and development on field emitter devices is extremely active. Numerous problems however, continue to plague the production of suitable emitter devices. These problems include flashover control, electron divergence control, film stress minimization, satisfactory emitter tip formation, and flexible emitter device fabrication.

Preventing flashover is an important goal of FED development efforts. Flashovers are discharges between adjacent gates, between emitter tips and gates, and even between gates and the anode. Though the space between the emitter and the anode may typically be evacuated in an FED, the materials that make up the FED are likely to outgas over time. Outgassing is caused by adsorbed and absorbed gas molecules in the glass and metal structures of the FED that escape into the vacuum space. These gas molecules may become ionized as a result of being bombarded by the electrons emitted from the field emitter tips. The ionized gas molecules may provide an electrical path for flashovers. In FEDs in which the potential between the anode and the cathodes is in the range of thousands of volts, such flashovers may be catastrophic to the device. Even if the flashover is not initially catastrophic, flashover may vaporize materials in the FED, resulting in the production of additional gas molecules, and sowing the seeds for future flashover.

Another problem which has been encountered in the operation of FEDs is the scattering of electrons emitted from the tips. Under the pull of the strongly positively charged anode, emitted electrons preferably impinge on a phosphor particle located directly opposite the tip from which the electron is emitted. Due to the influence of laterally spaced gates, however, some portion of the emitted electrons may deviate slightly from a straight pathway. There may be some horizontal dispersion of electrons by the time they reach the phosphor layer. This dispersion increases pixel size impinges on adjacent pixels, reducing the resolution of the display.

Both the risk of flashover, as well as the horizontal dispersion of emitted electron may be reduced through the use of lower gate voltages. The magnitude of gate voltage necessary to obtain a desired electron emission current is dependent upon the inherent work function of the emitter tip material as well as the surface curvature of the emitter. This dependency may be understood during an examination of the physics of field emission of electrons. As is well known in the art, field emission of electrons may be explained by Fowler-Nordheim, or quantam-mechanical, tunneling. Normally, electrons cannot escape from a metal unless the metal is heated. However, under sufficiently high applied fields, electrons can tunnel through the barrier, even at low temperatures. The rate of the electron field emission is dependent upon the material's inherent work function and the applied field which can be enhanced by the surface curvature of the emitter.

Thus, it is advantageous to use low work function materials for emitter tips. This permits lower gate voltages. Lower gate voltages reduce the risk of flashover. They also decrease the horizontal dispersion of emitted electrons. Other benefits of lower gate voltages include: lower cost cathode and gate driver circuitry, simplified gray scale implementation, reduced power loss in charging cathode and gate lines, and faster devices for non-display applications. Voltages below 25 volts result in additional benefits, such as the opportunity to use inexpensive MOS drivers, the elimination of ion sputtering as a cause of emission decay, and improved pixel spot size control due to reduced lateral electron energy and, hence, reduced horizontal dispersion.

Emitter tips may be formed by a variety of processes well known in the art such as molding, etching or evaporation. The emitter materials may be deposited by various processes, including evaporative deposition, chemical vapor deposition (CVD), plasma enhanced chemical vapor deposition (PECVD), and sputtering processes. Metal emitter tips are typically formed by evaporated deposition. Whatever formation method is employed, it is important that the chosen method applied to the given material results in an emitter tip with a high surface curvature. Likewise, it is important that the emitter tip material exhibit low surface mobility to prevent dull emitter tip profiles.

When the evaporative tip formation technique is used to form the emitter tip (cone), it is also desirable that the emitter materials have a moderately high aspect ratio (the ratio of the base of the tip to its height). Too small a ratio limits the gate insulator thickness for any given gate hole diameter. Too large a ratio demands an excessively thick insulation for any given hole diameter. Excessively thick insulation is difficult to fabricate and to clean out after subsequent processing. Values of aspect ratio between 1 and 2 produce a good compromise between gate hole diameter and insulation thickness.

Unfortunately, many materials previously tried as emitter tips have either not formed a high aspect ratio tip, or have high surface mobility leading to dulling and rounding of the tip. For example, poor materials include titanium, aluminum and nickel.

The challenge of making a viable FED does not end when a suitable low work function material has been formed into a high aspect ratio tip. A perennial problem has been the formation of non-conductive oxides on the emitter tips. Vacuum sealing operations used to make FEDs often involve high temperature processing. Slight partial pressures of oxygen or moisture may be present in an imperfect vacuum, allowing oxides to form on the emitter tip material. These oxides are often non-conductive, or at a minimum, less conductive than the pure emitter tip material. The result is a higher emitter tip work function, necessitating the use of higher gate voltages, with the concomitant deleterious effects herein previously discussed.

Many materials and methods have been tried to overcome this tip oxidation problem. Itoh et al., U.S. Pat. No. 5,469,014 (Nov. 21, 1995), for a "Field Emission Element," for example, teaches an electron emitter having a base and a tip portion wherein the base is made of Ti or Cr, while the tip is made of Ta, Nb, TiN, T, C or Mo. The tip exhibits low oxygen bonding strength, while the base has a higher oxygen bonding strength. As a result, atoms and/or molecules entering the tip or base are absorbed on the base material without forming any oxide layer on the tip.

Another problem experienced by field emitter tips is nonuniform or excessive current. Current production is exponential with the electric field applied across the tip. The field is a function of gate voltage, gate to tip distance, and tip sharpness. Small variations in tip sharpness, for example, can produce significant variations in current. These variations are exhibited as nonuniformity in screen brightness, and if excessive, may explosively melt emitter tips causing defects. Current limiters are used to control current production.

Current-limiting materials are often employed in the layers below the emitter tips to limit the current exiting each of the emitters. In devices employing cathodes spaced laterally from emitter tips, with current-limiting material disposed therebetween, a conductive pad may be used as a base for emitter tips within a pixel to equalize the potential at each of the tips. Though such devices exhibit beneficial current limiting properties, as well as increased device stability, emitter-to-emitter electron emission uniformity within a pixel may still be less than desirable. Emission nonuniformity among emitters within a pixel may be due to current stealing by emitters which have lower effective resistivity because of variations in composition and shape.

The evaporative deposition techniques by which metal emitter tips are often formed, such as in a Spindt-type emitter fabrication process, involve difficulties which have not been always satisfactorily resolved. Some materials exhibit compositional changes during evaporation and deposition, resulting in unpredictable emitter performance.

The evaporative deposition process occurs at temperatures at or above the evaporation temperature of a given emitter tip material. Refractory materials such as molybdenum, a commonly used emitter tip material, require relatively high temperatures such as, for example, greater than 3000° C. These materials are often difficult to evaporate and are, therefore, not ideal. Thus, there is still a need for materials which minimize these evaporative deposition problems.

Another problem confronting designers of FEDs is maintaining flexibility in selection and ordering of fabrication process stages. FEDs are commonly formed by semiconductor manufacturing processes which are well known in the art. These processes often include fabrication steps which entail exposure of the emitter tip material to various acids and bases. Unless the emitter tip material is relatively chemically inert in the presence of these acids and bases, fabrication process options are limited. For example, acids and bases can provide electrolytes which either etch emitter tips or coat emitter tips, degrading their performance.

Minimizing film stresses is another challenge facing the FED industry. FEDs are commonly constructed using glass substrates as foundations for a series of film layers in accordance with well known semiconductor fabrication layering techniques. High film stresses may develop within the thin layers of these devices. Film stresses are undesirable because cracks may develop in these layers and may propagate to other layers of the structure causing broken conductor pathways or shorts.

Various materials have been tried as emitter tips in the hope of solving these problems and achieving these sometimes mutually inconsistent goals. Materials that have been tried include Ti and Al. Materials such as pure Cr, for example, are not suitable for electron emitter tips because of their inherently high film stress and its tendency to form a difficult to remove oxide surface. Most cermets exhibit unduly high resistivity. In sum, each material previously employed as an emitter tip has certain drawbacks.

What is needed is a high performance emitter tip material which can be formed into high aspect ratio, low work function tips which maintain their shape, thus minimizing flashover risks and electron scattering problems, and which at the same time permits a high level of fabrication process flexibility, while minimizing film stresses.

OBJECTS OF THE INVENTION

It is therefore an object of the present invention to employ a high performance electron emitter material.

It is another object of the present invention to employ a high performance electron emitter material which has a high aspect ratio.

It is another object of the present invention to employ a high performance electron emitter material which forms a sharp point when deposited.

It is another object of the present invention to utilize a high performance electron emitter material which can be deposited through evaporation.

It is another object of the present invention to utilize a high performance electron emitter material which can be deposited with minimal composition change.

It is another object of the present invention to identify a high performance electron emitter material which exhibits low surface mobility.

It is another object of the present invention to employ a high performance electron emitter material which is chemically inert to most acids and basis.

It is another object of the present invention to employ a high performance electron emitter material which increases fabrication process options.

It is another object of the present invention to employ a high performance electron emitter material which has a low surface work function.

It is another object of the present invention to employ a high performance electron emitter material which is suitable for electron tunneling emission at practical voltages.

It is still another object of the present invention to utilize a high performance electron emitter material which exhibits a moderately low film stress relative to many other materials.

It is another object of the present invention to identify a high performance electron emitter material which has a relatively low oxidation-electron emission sensitivity.

It is yet another object of the present invention to identify a high performance electron emitter material which form conductive or moderately conductive oxides.

It is another object of the present invention to employ a high performance electron emitter material which may be vapor deposited at relatively low temperatures.

It is yet an additional object of the present invention to provide a high performance electron emitter material which may act as a combined emitter and current limiter.

It is another object of the present invention to employ a high performance electron emitter material which provides improved emitter electron emission uniformity within a pixel.

Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenges, the inventors have identified a class of novel emitter materials which permit simultaneous achievement of the above objects. The high performance emitter of the invention comprises a Cr and SiO mixture. A preferred embodiment comprises a field emitter comprising a mixture of between approximately 70 and 90% Cr by weight and SiO. This high-Cr and SiO mixture can be tailored to a suitably low film stress on glass substrates layered devices, and the mixture can be evaporated into sharp edged cone or wedge edge structures easily, while at the same time satisfying the other objects detailed above.

In another embodiment having reduced oxidation sensitivity, one or more impurities are added to the Cr—SiO composition. This embodiment comprises a field emitter comprising, by weight, not more than approximately 15% by weight of one or more first materials selected from the group comprising: Sc, Zn, $W_2O_3$, $Sc_2O_3$ and Fe; and not less than approximately 85% by weight of a second material comprising between 70 and 90% Cr by weight and SiO. The impurities, Sc, Zn, $W_2O_3$, $Sc_2O_3$ or Fe, are materials which are conductive oxides or will form conductive oxides. The concentration of the impurity should typically be less than approximately 15% by weight relative to the Cr—SiO mixture in order for the other desirable Cr—SiO emitter properties to be partially maintained.

A class of semi-conductive and conductive metal oxides comprises another embodiment of the invention. The metal oxides of this embodiment are more resistive than the Cr—SiO material, and therefore have increased current limiting properties. This class includes field emitters comprising a material selected from the group comprising oxides of Cr, Mo, Ni, Fe and Sc. The enhanced current limiting characteristic of these metals oxides may be desirable for applications where improved electron emission uniformity is desired among emitters within a pixel which uses a conductive pad.

Emission from these more resistive emitter tip materials may be optionally enhanced with the addition of one or more low work function impurities such as, for example, alkali metals, Ba and Sc. This leads to more stable devices with better chemical resistance while still permitting low turn-on voltages.

The present invention is directed to an improved field emitter display device. The improved display includes at least one emitter element containing Cr and SiO. The at least one emitter element may include between approximately 70 and 90 weight percent of Cr.

The at least one emitter element may further include at least one material selected from the group consisting of Sc, Zn, $W_2O_3$, $Sc_2O_3$, and Fe. The at least one field emitter may include between approximately zero and 15 weight percent of the at least one material selected from the group consisting of Sc, Zn, $W_2O_3$, $Sc_2O_3$, and Fe. The at least one emitter element may include approximately 85 weight percent of a mixture of Cr and SiO where the mixture may contain approximately 70 and 90 weight percent of Cr.

The present invention is also directed to a field emitter element for use in a field emitter device. The field emitter element includes an emitting element formed from Cr and SiO. The emitting element includes between approximately 70 and 90 weight percent of Cr. The emitting element may further include at least one material selected from the group consisting of Sc, Zn, $W_2O_3$, $Sc_2O_3$, and Fe. The emitting element may include between approximately zero and 15 weight percent of the at least one material selected from the group consisting of Sc, Zn, $W_2O_3$, $Sc_2O_3$, and Fe. The emitting element may include approximately 85 weight percent of Cr and SiO. The mixture of Cr and SiO may include between approximately 70 and 90 weight percent of Cr.

The present invention is also directed to a method of forming a field emitter element for use in a field emitter display device. The method may comprise the step of forming an emitting element having Cr and SiO. The method may include the steps of forming a mixture of Cr and SiO, and depositing the mixture on a surface to form an emitter tip. The emitter element may be produced by codepositing Cr and SiO on a surface to form an emitter tip. This may be accomplished by evaporatively codepositing Cr and SiO on the surface to form the emitter tip.

The present invention is also directed to an improved a field emitter display device having a substrate, a conducting layer formed on the substrate, an insulator layer, a resistive layer formed on the insulator layer, a conductive pad formed on the resistive layer and at least one emitter element formed on the conductive pad. The improved device includes at least one emitter element containing a material selected from the group consisting of $Cr_2O_3$, NiO, $Mo_2O_3$, $Fe_2O_3$, and $Sc_2O_3$. The at least one emitter element may further include a low work function material. The low work function material may be selected from the group consisting of alkali metals, barium and scandium.

The present invention is also directed to a field emitter element for use in a field emitter device. The field emitter element includes an emitting element containing a material selected from the group consisting of $Cr_2O_3$, NiO, $Mo_2O_3$, $Fe_2O_3$, and $Sc_2O_3$. The emitting element may further include a low work function material.

The present invention is also directed to a method of forming a field emitter element for use in a field emitter display device. The method includes the steps of forming an emitting element containing a material selected from the group consisting of $Cr_2O_3$, NiO, $Mo_2O_3$, $Fe_2O_3$, and $Sc_2O_3$. The method may further include the step of adding a low work function material.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention, and together with the detailed description serve to explain the principles of the present invention.

BRIEF DESCRIPTION OF THE DRAWINGS

The present invention will now be described in connection with the following figures in which like reference numbers refer to like elements and wherein.

DETAILED DESCRIPTION OF THE PREFERRED EMBODIMENTS

Reference will now be made in detail to a preferred embodiment of the present invention, an example of which is illustrated in the accompanying drawings. A preferred embodiment of the present invention is shown in FIG. 1 as device 10 which may be included in a field emitter display.

Figure 1:
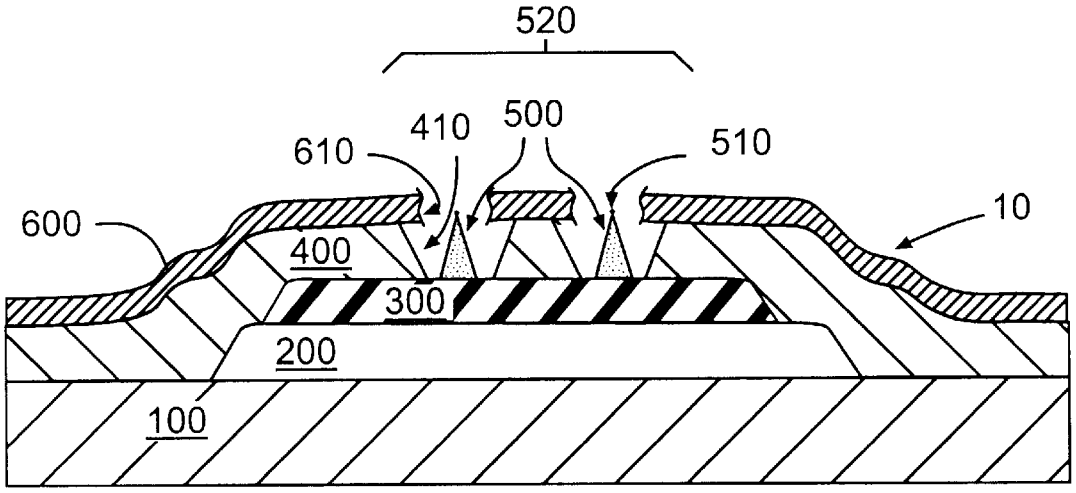
FIG. 1 is a cross-sectional view in elevation of a preferred embodiment of a field emissive device of the present invention; and, FIG. 2 is a cross-sectional view in elevation of a field emissive display employing a preferred embodiment of a field emissive device of the present invention.

With reference to FIG. 1, a basic FED emitter device 10 may include a glass substrate 100 with a cathode line 200 provided thereon. A current limiter 300 may be provided on the cathode line 200, and high performance emitters 500 may be provided on the current limiter 300.

The emitters 500, are preferably shaped to have a fine point 510 which enhances the electron emission capability of the emitters. The emitters 500 may be provided in wells 410 formed in a layer of insulator material 400. A gate line 600 may be provided over the insulator layer 400 with holes in the gate line above the emitters 500. The edges of the holes in the gate lines may be referred to as the gates 610 for a particular emitter. Plural emitters 500 may be arranged into groups 520 having a square, rectangular, circular, or some other geometric pattern as viewed from above.

Emission of electrons from the tips 510 is brought about by generating an electrical field at the tips which is conducive to electron emission. The fine point of the tips concentrates the electric field at the tips and enhances the likelihood that electrons will tunnel from the tips in a generally upward direction. To achieve emission, this electric field must be generated in conjunction with the application of a particular voltage to the cathode line 200 underlying the emitter tips 510. The electrical field may be generated by increasing the positively charged voltage applied to the gate line 600. Consequently, the electrons are induced to tunnel from the tips 510 under the influence of the positively charged gates 610.

Figure 2:
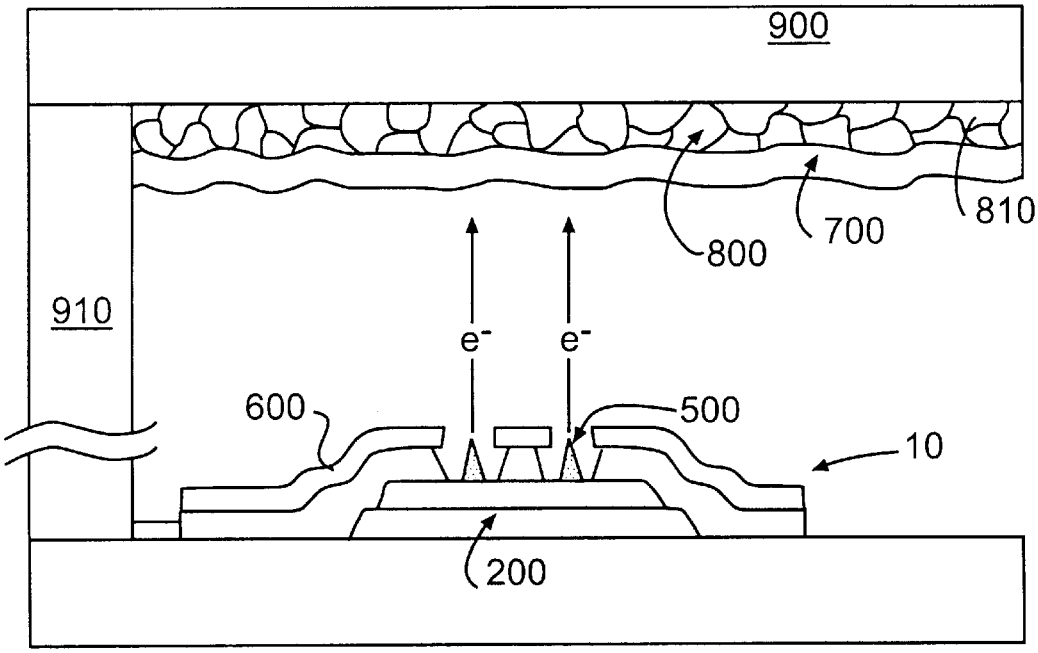

FIG. 2 shows a field emissive display employing an embodiment of a device of the present invention. Once emitted, the electrons travel upward under the influence of a highly positively charged anode 700 above the field emitter. Typically, the anode 700 of a display may be provided by a thin conductor layer. Anode 700, in concert with cathode 200, may form an electric field of 10 V/$\mu$, for example, depending on the voltage differential. A layer of phosphors 800, consisting of individual phosphorescent grains 810, may be provided on a second glass substrate 900 adjacent the anode 700. Electrons attracted to the anode 700 strike the phosphors, causing them to glow, and light emitted through the top side of the glass substrate 900 may be viewed as part of an image, text, etc.

In order to operate a display, the space between the field emitters 500 and the anode 700 should be evacuated. Typically, this space may be on the order of a 2 millimeter gap. The glass substrate 100 underlying the emitters 500 and the glass substrate 900 supporting the phosphors 800 may be sealed to one another along their respective edges using a glass frit 910. After being sealed, the space between the two glass substrates, 100 and 900, may be evacuated of gas and sealed off from the outside atmosphere.

The high performance emitter 500 of the invention is preferably formed on resistive layer 300. Alternatively, emitter 500 may be formed on an insulating layer, on a conductive pad, or on another layer and in other configurations in which an FED emitter device may be constructed. As embodied herein, high performance emitter 500 comprises a mixture of SiO and between approximately 70 and 90% Cr by weight. Emitter 500 is preferably formed by evaporative codeposition of its SiO and Cr components using a Spindt-type process. Alternatively, the source SiO and Cr materials may be pre-mixed and then evaporatively deposited. Additionally, in other embodiments of the invention, emitter 500 may be formed by other suitable deposition processes. These processes may include using CVD, PECVD, sputtering, etc.

The evaporation temperatures of the Cr and SiO components of the emitter of the invention are relatively low when compared to the higher temperatures required for evaporative deposition of other commonly used emitter materials. Mo, a commonly used emitter tip material, requires temperatures in excess of 3,000° C., for example. Other refractory materials often used as emitters, require similarly high temperatures. Examples include W and Nb. The relatively low evaporation temperatures of the Cr and SiO components of the emitter of the present invention help reduce adverse effects that may attend high temperatures caused by radiant heating from the source. These adverse effects include stress cracking and shifting of the close off point.

Furthermore, when evaporatively deposited using the preferred Spindt-type process, the Cr and SiO materials of the emitter of the present invention exhibit minimal compositional changes during deposition. For example, this is when the Cr separated from the SiO during the deposition.

Various semiconductor manufacturing processes may be employed in forming FED emitter device 10 of the invention. These semiconductor fabrication processes may include well known fabrication steps, such as masking, photoresist, lift off, various deposition techniques, and etching processes, among others. These various fabrication steps may entail exposure of the emitter tip 500 to various acids and bases such as: Aqua regica, Nitric acid, HF, $H_2SO_4$, HCI, KoH Solution and NaOH solution. The Cr—SiO mixture of the invention is chemically inert in the presence of most of these acids and bases. The Cr—SiO emitter of the invention thereby enables a high degree of flexibility in applying and in the ordering of various semiconductor manufacturing processes during device construction.

Though other fabrication methods are within the scope of the invention, well known semiconductor fabrication techniques are preferably used to form a layered structure using a glass substrate as the foundation for a series of film layers as depicted in the figures. These layering techniques may involve depositing layers of different materials seriatim, on top of each other, in addition to patterning and shaping each layer using a variety of known techniques such as masking, photoresistive patterning, etching, etc. The novel emitter material of the invention exhibits a relatively low film stress relative to many other materials typically layered on glass substrates. For example, Cr must be restricted to very thin films otherwise the film may crack and may even introduce cracks into underlying layers.

In addition to forming a high aspect ratio when evaporated using a Spindt-type process, as well as having an inherently low surface mobility, the Cr—SiO mixture of the invention has a relatively low surface work function suitable for electron tunneling emission at practical voltages.

The novel Cr—SiO mixture of the invention has a relatively low oxidation-electron emission sensitivity because it forms slightly conductive oxides. In this way, a moderately low net surface work function for the emitter is maintained even in the presence of oxidation.

Because it may form and maintain a high aspect ratio tip, and because it possesses a relatively low surface work function even under the presence of oxidation, the Cr—SiO electron emitter material of the invention permits relatively low gate voltages to be used in a functioning FED device. Lower gate voltages result in numerous beneficial aspects and alleviate many of the problems which have plagued the industry. These benefits include a reduce risk of flashover, decrease horizontal deflection of emitted electrons, the ability to use lower cost cathode and gate driver circuitry, simplified gray scale implementation, reduced power waste in charging cathode and gate lines, and the enablement of faster devices for non-display applications. At gate voltages below 25 volts, which may be obtained with the invention, additional benefits are realized. These benefits include the opportunity to use less expensive MOS drivers, the elimination of ion sputtering as a cause of emission decay, and even further improved pixel spot size control due to reduced lateral electron energy.

Varying the Cr—SiO balance within the 70–90% by weight Cr range may affect the advantageous characteristics of the emitter in different ways and to different degrees. One or more impurities may be added to Cr—SiO mixture, with the beneficial result of decreased oxidation sensitivity. This minimizes the formation of high resistivity oxides. Alternatively, Zn, $W_2O_3$, $S_{C2}O_3$ and/or Fe impurity may be added to the Cr—SiO emitter material composition. These impurity materials form conductive oxides, thus reducing the net oxidation sensitivity of the emitter. The concentration of impurity is preferably less than approximately 15% by weight relative to the Cr—SiO mixture in order for the other desirable Cr—SiO emitter properties to be partially maintained. An emitter of this embodiment is preferably made via codeposition. Alternatively, the source materials may be mixed and then deposited. Preferably a Spindt-type process is used, though in other embodiments alternative emitter formation processes may be employed. Some compositional change during evaporation is acceptable so long as the final concentration of impurity is less than approximately 15%. Thus, through proper selection and concentration of impurities, an emitter tip can be provided which possesses controllable relative degrees of oxygen insensitivity and other desirable properties, such as a net low surface work function.

An alternative embodiment of the present invention comprises a class of emitter tip materials offering an additional beneficial characteristic, especially realized when employed with FED devices using a potential-equalizing conductive pad at the base of emitters within a pixel. Such devices often exhibit uneven electron emission currents among emitters within a pixel due to current stealing. Comprising several semiconductive and conductive metal oxides, this class of emitter tip materials are more resistive than Cr—SiO and can therefore act as a combined emitter and current limiter. The preferred semiconductive and conductive metal oxides of this embodiment of the invention include oxides of Cr, Mo, Ni, Fe and Sc. The inherent current limiting property of these materials may be a desirable characteristic for applications in which improved electron emission uniformity among emitter tips is desired within a pixel which use a conductive pad.

Previous emitter tip material sources have focused on high conductivity. However, the resistive emitter tip materials of this embodiment of the invention may be advantageously employed by increasing the number of emitters per pixel. Thus, the total desired electron current can be achieved while enjoying the benefits of these more resistive emitter tip materials. Besides increased electron emission uniformity within a pixel, these benefits include increased device stability and enhanced chemical resistance, while still permitting low turn-on voltages.

A preferred emitter tip material choice, for example, is $Cr_2O_3$. An alternate preferred material is NiO. These two metal oxides possess good chemical resist properties, are chemically inert, and form conductive oxides. An emitter of this embodiment of the invention is preferably made via deposition in a Spindt-type process. Alternatively, other suitable deposition processes such as CVD, PECVD, sputtering, etc., may be employed.

In a variation on this embodiment of the invention, low work function impurities such as alkali metals, Ba and Sc, may be added to this class of resistive metal oxides to enhance electron emission from the emitter tips. For example, a composition of Cr (60%), SiO (35%), $SC_2O_3$ (5%) [wt %] may be used. In other embodiments from 2 to 20 weight % of the reactive metal may be employed. An emitter of this embodiment is preferably made via codeposition. Alternatively, the source materials may be mixed and then deposited. Preferably, a Spindt-type process is used, though in other embodiments, alternative emitter formation processes may be employed.

Thus, through proper selection of emitter tip metal oxide material and addition of a suitable amount of an appropriate low work function impurity, an emitter tip can be obtained which possesses controllable relative degrees of beneficial characteristics such as conductivity, resistivity, device stability and chemical resistance.

It will be apparent to those skilled in the art that various modifications and variations can be made in the construction, configuration, and/or operation of the present invention without departing from the scope or spirit of the invention. For example, in the embodiments mentioned above, various changes may be made to the emissive display or other device in which the novel emitter is employed. Further, it may be appropriate to make additional modifications, such as adding other impurities to the novel emitter materials of the invention, or varying the way the device as a whole is fabricated, or the way the emitter material is deposited. Thus, it is intended that the present invention cover the modifications and variations of the invention provided they come within the scope of the appended claims and their equivalents.

What is claimed is:

1. In a field emitter display device including a substrate, a conducting layer formed on the substrate, an insulator layer, a resistive layer formed on the insulator layer and at least one emitter element formed on the resistive layer, the improvement comprising said at least one emitter element includes Cr and SiO.

2. The device according to claim 1, wherein said at least one emitter element includes between approximately 70 and 90 weight percent of Cr.

3. The device according to claim 1, wherein said at least one emitter element further includes at least one material selected from the group consisting of Sc, Zn, $W_2O_3$, $Sc_2O_3$, and Fe.

4. The device according to claim 3, wherein said at least one field emitter includes between approximately zero and 15 weight percent of the at least one material selected from the group consisting of Sc, Zn, $W_2O_3$, $Sc_2O_3$, and Fe.

5. The device according to claim 4, wherein said at least one emitter element includes approximately 85 weight percent of a mixture of Cr and SiO.

6. The device according to claim 5, wherein said mixture for said at least one emitter element includes between approximately 70 and 90 weight percent of Cr.

7. A field emitter element for use in a field emitter device, said field emitter elements comprising:

an emitting element formed from Cr and SiO.

8. The field emitter element according to claim 7, wherein said emitting element includes between approximately 70 and 90 weight percent of Cr.

9. The field emitter element according to claim 7, wherein said emitting element further includes at least one material selected from the group consisting of Sc, Zn, $W_2O_3$, $Sc_2O_3$, and Fe.

10. The field emitter element according to claim 9, wherein said emitting element includes between approximately zero and 15 weight percent of the at least one material selected from the group consisting of Sc, Zn, $W_2O_3$, $Sc_2O_3$, and Fe.

11. The field emitter element according to claim 10, wherein said emitting element includes approximately 85 weight percent of Cr and SiO.

12. The field emitter element according to claim 11, wherein a mixture of Cr and SiO includes between approximately 70 and 90 weight percent of Cr.

* * * * *